United States Patent [19]

Avrillon et al.

[11] 4,045,330

[45] Aug. 30, 1977

[54] PROCESS FOR REGENERATING LUBRICATING OILS

[75] Inventors: René Avrillon, Maisons Laffitte; Daniel Defives, Paris, both of France

[73] Assignee: Institut Francais du Petrole, Rueil-Maimaison, France

[21] Appl. No.: 692,861

[22] Filed: June 4, 1976

[30] Foreign Application Priority Data

June 4, 1975 France ..... 75.17662

[51] Int. Cl.[2] ..... C10M 11/00

[52] U.S. Cl. ..... 208/180; 208/181; 208/184

[58] Field of Search ..... 208/180, 181, 182, 184, 208/179

[56] References Cited

U.S. PATENT DOCUMENTS

| | | | |
|---|---|---|---|
| 1,703,645 | 2/1929 | Brunt | 208/180 |
| 2,320,106 | 5/1943 | South | 208/180 |
| 3,785,968 | 1/1974 | Whitehurst | 208/251 R |
| 3,919,075 | 11/1975 | Parc et al. | 208/182 |

*Primary Examiner*—Delbert E. Gantz
*Assistant Examiner*—James W. Hellwege
*Attorney, Agent, or Firm*—Millen & White

[57] ABSTRACT

Used lubricating oil is contacted with particles of a solid adsorption resin comprising at least 0.1 cc per gram of pores of diameter in the range of 6 to 300 angstroms. The resin is preferably a porous polycondensate or cross-linked copolymer comprising pyridyl or hydroxy groups, for example a polycondensate of phenol and formaldehyde. The resin may be reactivated by rinsing with an organic solvent such as an alcohol, a ketone or a chlorinated hydrocarbon.

16 Claims, No Drawings

PROCESS FOR REGENERATING LUBRICATING OILS

The invention relates to a process for regenerating used lubricating oils, particularly those from internal combustion engines of vehicles.

The regeneration of used lubricating oils is traditionally effected by treatment with sulfuric acid and decolorizing earth. The disadvantage of this treatment is the production of substantial amounts of residues which cannot be deposed of easily since they are terrestial pollutants, or upon incineration, atmospheric pollutants. In an increasing number of countries, the law tends to become more and more restrictive for this type of operation.

Accordingly, for a few years, research has been carried out to find regeneration processes of a lower polluting effect. Thus, a process according to which used oil is subjected to clarification with liquid propane and/or butane is applied industrially. Other techniques have also been proposed, such as ultrafiltration, extraction with an oxygen-containing solvent, and also improved distillation methods.

These various techniques eliminate from used oils a part of their impurities but are insufficient to attain, when used alone, the specifications of the virgin lubricating bases. When these techniques are employed, there remains in the oil, a small amount of oxidized hydrocarbons which produce a dark shade and acidity; there can also remain metal derivatives and polycyclic substances which yield, by combustion, ash and coal residues respectively. When speaking in terms of standard specifications (AFNOR), these partially purified oils have, as a rule, a Union color far over 8, an acid number over 0.3, a Conradson carbon residue over 0.15% and/or an ash content higher than 0.005% ; the corresponding values for solvent-refined virgin bases are usually lower than 4; 0.1; 0.1; and 0.005 respectively. When the residual metal content is very low, the oil treatment may be finished by catalytic hydrogenation, a non-polluting treatment, provided hydrogen is available. In fact, even the plants for oil regeneration operated according to the new techniques, an additional treatment with sulfuric acid and earth is applied since this is a well-known and relatively inexpensive method. Although this is a light acid treatment, and not a strong one as in the conventional regeneration, the operation remains a non-negligible source of pollution.

A first object of the present invention is to provide a process for purifying used oils, which yields oils conforming to the specifications of lubricating bases, particularly as concerns color, acid number, Conradson residue and/or ash content. Another object is to propose a non-polluting purification process which employs neither sulfuric acid nor any substance yielding polluting residues. A further object is to provide a purification process which does not require hydrogen and may be applied as well in units of very small size as in plants of large capacity.

In the process according to this invention, the used oil to be purified is contacted with an adsorption resin; the impurities may be desorbed thereafter by means of an organic solvent.

Used lubricating oils, particularly those from internal combustion engines of vehicles, contain various impurities in suspension or in solution. The treatment according to the invention applies preferably to used oils containing only dissolved impurities; it applies particularly to the thorough purification of used oils previously clarified with propane and/or butane, or even distilled or ultrafiltered. This treatment is based on the property of the resins employed in the present process to adsorb the impurities more strongly than the oil itself, while the impurities retained may themselves be displaced easily by means of an adsorbable organic solvent.

The adsorption resins which may be used, in the pure state or as mixtures, in the process of the invention are porous polycondensates or cross-linked copolymers comprising hydroxy groups linked directly or through a $-CH_2-$ or $$-\overset{|}{C}H-$$

group to a benzene ring, and/or pyridyl groups; their useful pore volume, i.e. the volume of the pores of diameter from about 6 to 300 angstroms, is at least 0.1 cc per gram, for example, from 0.1 to 0.8 cc per gram. The pore volume may be determined, for example, by nitrogen adsorption according to the so-called B.E.T. method or by isopentane or methyl isobutyl ketone adsorption; the latter two substances do not penetrate pores of a diameter lower than about 6 angstroms; mercury porosimetry may also be used while it applies only to pores of diameter larger than about 38 angstroms.

Particularly effective adsorption resins for treating used oils are the porous polycondensates of phenol and/or resorcinol with formaldehyde and/or 2-furaldehyde, such as the phenol-formaldehyde resin commercialized by Dia-Prosin Company under the name Duolite S 30, and the porous polycondensates of aliphatic ketones with bis-arylaldehydic compounds optionally comprising one or more phenol and/or pyridyl groups between the two terminal aromatic aldehyde groups; one example of the latter type of adsorption resin is the resin discovered by Société Rhône-Poulenc, having the reference YD 74 and which is a polycondensate of acetone and bis 4,4'-(paraformylstyryl) -2,2'-bipyridyle.

Other resins are the porous cross-linked copolymers of (a) at least one vinykpyridine and (b) at last one polyunsaturated monomer such as divinylbenzene, with possibly another monomer having ethylenic unsaturation.

The preparation of the adsorption resins to be used in the present process is carried out under known conditions leading to the formation of polymers having a microporous structure. However, for some resins, for example those of the ketone-bisarylaldehyde type, porosity is normally present only if the resin is impregnated with a liquid; if the latter is removed, for example by evaporation under vacuum, porosity disappears, but it may appear again, more or less easily, by using certain solvents, one of the most effective being methylene chloride. In that case the methods for measuring the pore volume by nitrogen adsorption or mercury penetrating do not apply. One may have recourse, however, to the adsorption determination of methylisobutylketone.

The adsorption resins are active for the purification of oils only if they are practically anhydrous, i.e. if they contain less than 3%, preferably less than 1% b.w. of water (determined by the Karl Fischer method). It may happen that water is present, either in the fresh resin, depending on the manufacture process, or in the resin under use, by accident. The adsorption resins of the process are stable only below such temperatures as 80° C; it is then desirable to dehydrate them, not by heating, but by rinsing with a light alcohol or a light ketone, for example an alcohol of less than 5 carbon atoms or a ketone of less than 7 carbon atoms. It will be shown thereafter that such substances are useful for reactivating the resin after use. It is then advantageous to employ the same substance for the dehydration and the reactivation of the resin. The resins may also be dehydrated by keeping them under vacuum or in a dry atmosphere, but this method should be avoided when treating resins of the ketone-bisaromaldehyde type.

In the present process, the adsorption resins are used as particles of any shape; their particle size is preferably lower than 3 mm and usefully from 0.3 to 1.2 mm.

The oil may be contacted with the adsorption resin in any manner, for example according to the technique of the fixed or fluidized bed, the fixed bed being however preferred. As the lubricating oils have a high viscosity, it is advantageous to dilute them before processing. The diluent may be any substance which is neither polar nor polarizable, is relatively volative with respect to the oil in order to be separable therefrom by distillation, and appears at the processing temperature as a liquid of low viscosity, preferaly lower than 0.5 centipoise. Highly advantageous diluents are saturated aliphatic and alicyclic hydrocarbons whose molecule contains 3 to 7 carbon atoms. The dilution rate, expressed as parts by volume of diluent per part of oil, is preferably from 1 to 4, although lower or higher rates may be used. In fact, in many cases, it is not necessary to effect this dilution since the oil has been diluted with a liquid during the operations of preliminary purification, and this liquid is also adapted to the treatment with the resin.

A rather strict condition, when using adsorption resins, is the operating temperature. In fact, as stated hereinbefore, the resins which are employed in the present process are stable only below a limit temperature which is about 80° C. It is then preferale to operate at a temperature not in excess of about 50° C. There is no lower temperature limit, except that imposed by considerations of viscosity of the liquid treated.

As to the pressure, it is practically without effect on the resin. The pressure is normally atmospheric, but a higher pressure may be used without disadvantage when it is necessary to maintain the diluent in the liquid state.

The relatively slow kinetics of the impurity sorption require rather long contact times. This results from the fact that most of the impurities appear as bulky molecules which penetrate slowly into the porous net of the resin. A small particle size of the resin and a low viscosity of the liquid medium help to reduce contact time necessary to correctly purify the oil. When operating in fixed bed, the contact time, defined as the residence time of the liquid in the bed, is longer than 1 minute and usually in the range from a quarter of an hour to 1 hour for a particle size of 0.1 to 2 mm and a viscosity of 0.15 to 1.0 centipoise.

If desired, in view of improving the effect of the adsorption resin, the oil to be purified may be subjected to a preliminary treatment by means of a porous polymer of low polarity, preferably with large pores, able to retain quickly very big molecules of impurities and to release them easily when passing the solvent employed for reactivating the adsorption resin. Examples of polymers of low polarity are the porous acrylic polymers of commercial grade, preferably of the macroporous type, whose particle size is close to that of the adsorption resin to be used.

The amount of oil which can be purified with a given amount of adsorption resin depends on the concentration of the various residual impurities in the oil. Further, all the impurities are not retained by a given resin with the same efficiency. The operating conditions and, in particular, the mode of contact also influence the purification capacity of the resin. An advantageous mode of contact in this respect is percolation in fixed bed. As a guideline, the resins to be used in the present process permit, when in a fixed bed, the purification of 2 to 5 times their volume of oil.

The reactivation of the resins after use, i.e. the adsorption of the impurities, is carried out by washing with an organic solvent. The solvents to be used are, as a rule, organic substances of average polarity or polarizable substances liquid at the operating temperature and pressure, miscible to the oil or, at the very least, to the dilute oil, and separable from the oil and preferably also from the optional diluent, by distillation. Highly advantageous substances for the reactivation of the resins are aliphatic and alicyclic alcohols having from 1 to 6 carbon atoms per molecule, aliphatic and alicyclic ketones having from 3 to 7 carbon atoms, chlorinated hydrocarbons, for example mono-, di-, tri and tetrachloromethane, 1,2-dichloroethane, benzene, toluene, xylenes and ethylbenzene, and except for resins having pyridyl groups, pyridine and its methyl derivatives. As a practical rule, the washing solvents may be said substances either pure or as mixtures.

The larger the amount of the impurities to desorb, the bigger the volume of solvent to be used for the reactivation of the resins. However it may be reduced by choosing a convenient operating technique. The most advantageous technique, as regards the amount of solvent, is the fixed bed technique with circulation of the solvent in reverse direction to the oil, the liquid of larger density being circulated upwardly. The circulation of solvent is effected at a preferred flow rate of 0.5 to 4 volumes per volume of bed and per hour. In these conditions, the required volume of solvent is usually 0.1 to 2 times, preferably 0.3 to 0.8 times that of the oil to be purified. Another advantage of the fixed bed technique is the following: after washing with solvent, the bed can be used again; it is not necessary to remove the liquid or rinse with a diluent before percolating oil. In fact, the solvent hold-up is pushed by the oil an does not mix much with the latter, provided the liquid of higher density is discharged or injected (depending on what is concerned: solvent or oil) at the bottom of the bed.

The following purely illustrative examples will explain more fully the possibilities of the present invention. The analysis of metals has been conducted by atomic absorption, the analysis of phosphorus by emission spectrometry and the other determinations by standardized French methods (NF Afnor): Union colour (T 60-104), acid index (T 60-112), Conradson residue (T 60-116), ash content (M 07-037).

EXAMPLE 1

Oil finishing over fresh phenol-formaldehyde resin

A glass percolation column of 20 mm diameter and 102cm height is charged with 0.377 liter of phenol-formaldehyde resin of particle size from 0 .3 to 1.0 mm and useful pore volume of 0.65 cc per gram (determined on a sample dried in vacuo).

The resin is washed at room temperature with 900 cc of methylisobutylketone introduced from the top of the column at a rate of 250 cc per hour, to remove water (37g) and possible impurities of the resin. The residual water content is 0.8% b.w. Then, while the column remains full of solvent, there is introduced, from the top, regenerated used oil diluted with three times its volume of hexane, as recovered from an ultrafiltration plant. An effluent is simultaneously discharged at a rate of 600 cc per hour. The first 170 cc consist of solvent and are discharged; four successive fractions of each 1000 cc are collected; then the column, full of liquid, is isolated. The fractions are dehexanized in a progressive vacuum evaporator at increasing temperature.

The oil samples thus recovered in a total amount of 826 g are analyzed as shown in Table 1 also stating the characteristics of the starting oil.

EXAMPLE 2

Oil finishing over phenol-formaldehyde resin reactivated with methylisobutylketone The column of resin recovered from example 1 is reactivated at room temperature with 900 cc of methylisobutylketone injected from the bottom of the column at a rate of 250 cc per hour. From the top of the column, there is first recovered a hold-up of dilute oil (192 cc) and then suddenly a black liquid consisting of methylisobutylketone with desorbed impurities. This liquid is collected in a flask different from that used to collect the oil hold-up. After introduction of the above 900 cc of methylisobutylketone, the column, full of solvent, is fed from the top with dilute oil to be purified, as described in example 1.

The first 170 cc effluent are collected and admixed with the other portion of impurities containing solvent. The purified oil then appears and is collected, as in example 1, in four fractions of each 1000 cc. Then the column is isolated. The fractions are then treated in the evaporator and yield four samples of oil totalizing 828 g. The analyses of the latter give results (reported in Table II) which are close to those obtained in example 1, as shown by comparison with Table I. The impurities containing solvent is treated in the evaporator and yields 34 g of a viscous black residue, i.e. about 4% of the oil.

EXAMPLE 3

Oil finishing over a phenol-formaldehyde resin reactivated with methylene chloride (dichloromethane)

The column of resin of example 2 is reactivated with methylene chloride, and a new percolation of oil is effected. The operating conditions of the regeneration and percolation are the same as in example 2. The results are practically identical.

EXAMPLE 4

Oil finishing over a phenol-formaldehyde resin reactivated with pyridine

The column of resin of example 3 is reactivated with pyridine and oil is percolated again; the process is as in example 2. The results are similar to those of this example.

EXAMPLE 5

Oil finishing over a fresh bipyridylic resin

A column of the type described in the above examples is charged with 0.377 liter of Rhône-Poulenc YD 74 resin saturated with water (90g), of a particle size from 0.4 to 1.2 mm and a useful pore volume of 0.7 cc per gram of dehydrated resin (measured by isopentane adsorption).

Water is removed from the resin, as disclosed in example 1, while employing methylethylketone instead of methylisobutylketone. The residual water content is 0.5% b.w.

Then oil is percolated in the same conditions as in example 1. The results of the analyses of the four oil samples are given in Table III. These results are quite similar to those of example 1 as shown by comparison with Table 1.

EXAMPLE 6

Oil finishing over a bipyridylic resin reactivated with methylethylketone

The column of resin of example 5 is reactivated with methylethylketone and oil is percolated again. The process is conducted as in example 2. The results of the analyses of the oil samples are quite similar to those of example 5. The amount of residue in 35 g.

EXAMPLE 7

Oil finishing over a pyridylic resin reactivated with methylene chloride (dichloromethane)

The column of resin of example 6 is reactivated with methylene chloride and oil is percolated again under the same operating conditions as in example 2. The results are identical to those of example 6.

EXAMPLE 8

Purification of oil of high content of metal compounds over a phenolformaldehyde resin protected with a porous acrylic polymer, after washing with methylisobutylketone The column of resin of example 4 is arranged in series with a second column placed thereabove. The latter has a diameter of 20 mm and a height of 50 cm. It is filled with 0.157 liter of macroporous acrylic polyester in the form of little spheres of grain size between 0.2 and 0.6 mm, whose mercury porosity is 0.8 cc per gram (Amberlite ® XAD 8 of Rohn and Haas Company).

900 cc of methylisobutylketone is passed downwardly through these two columns at a rate of 250 cc per hour, in order to remove water from the upper column and reactivate the lower column. Partially purified used oil from an ultrafiltration plant (it had yet a high content of metal compounds and phosphorus compounds) is then introduced at the top of the upper column, after dilution with three volumes of hexane. Percolation is effected as in example 2. The results are given in Table IV. It appears that the metals have been removed to such an extent that the ash content is negligible.

TABLE I

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| Weight (g) | | 176.5 | 216.0 | 216.5 | 217.0 | 826.0 |

TABLE I-continued

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| Specific weight ($g/cm^3$) | 0.876 | 0.873 | 0.875 | 0.876 | 0.878 | 0.876 |
| Union colour | >8 | 2.5 | 3 | 4 | 5 | 3.5 |
| Acid number | 0.34 | 0.04 | 0.04 | 0.05 | 0.07 | 0.05 |
| Conradson residue | 0.16 | 0.06 | 0.07 | 0.08 | 0.09 | 0.08 |
| Ash content % b.w. | 0.006 | <0.002 | <0.002 | <0.0002 | <0.002 | <0.002 |
| Lead content (ppm) | 3.0 | <0.5 | <0.5 | <0.5 | <0.5 | <0.5 |
| Zinc content (ppm) | 1.7 | <0.05 | <0.05 | <0.05 | <0.05 | <0.05 |
| Calcium and barium content (ppm) | 6.0 | 0.5 | 0.5 | 0.5 | 0.5 | 0.5 |
| Iron content (ppm) | 1.7 | <0.1 | <0.1 | <0.1 | <0.1 | <0.1 |
| Phosphorus content (ppm) | 80 | <20 | 20 | 20 | 20 | 20 |

TABLE II

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| Weight (g) | | 178.0 | 217.0 | 216.0 | 217.0 | 828.0 |
| Specific weight ($g/cm^3$) | 0.876 | 0.874 | 0.875 | 0.876 | 0.878 | 0.876 |
| Union colour | >8 | 2.5 | 3 | 4 | 5 | 3.5 |
| Acid number | 0.34 | 0.04 | 0.04 | 0.05 | 0.07 | 0.05 |
| Conradson residue | 0.16 | 0.06 | 0.08 | 0.08 | 0.09 | 0.08 |
| Ash content (% b.w.) | 0.006 | <0.002 | <0.002 | <0.002 | <0.002 | <0.002 |
| Lead content (ppm) | 3.0 | <0.5 | <0.5 | <0.5 | <0.5 | <0.5 |
| Zinc content (ppm) | 1.7 | <0.05 | <0.05 | <0.05 | <0.05 | <0.05 |
| Calcium and barium content (ppm) | 6.0 | 0.5 | 0.5 | 0.5 | 0.5 | 0.5 |
| Iron content (ppm) | 1.7 | <0.1 | <0.1 | <0.1 | <0.1 | <0.1 |
| Phosphorus content (ppm) | 80 | <20 | 20 | 20 | 20 | 20 |

TABLE III

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| Weight (g) | | 176.0 | 215.5 | 216.5 | 217.0 | 825.0 |
| Specific weight ($g/cm^3$) | 0.876 | 0.870 | 0.875 | 0.878 | 0.879 | 0.876 |
| Union colour | >8 | 2 | 3 | 4 | 5 | 3.5 |
| Acid number | 0.34 | 0.03 | 0.04 | 0.05 | 0.07 | 0.05 |
| Conradson residue | 0.16 | 0.04 | 0.06 | 0.08 | 0.09 | 0.07 |
| Ash content (% b.w.) | 0.006 | <0.002 | <0.002 | <0.002 | <0.002 | <0.002 |
| Lead content (ppm) | 3.0 | <0.5 | <0.5 | <0.5 | <0.5 | <0.5 |
| Zinc content (ppm) | 1.7 | <0.05 | <0.05 | <0.05 | <0.05 | <0.05 |
| Calcium and barium content ~(ppm) | 6.0 | 0.8 | 0.8 | 0.8 | 0.8 | 0.8 |
| Iron content (ppm) | 1.7 | <0.1 | <0.1 | <0.1 | <0.1 | <0.1 |
| Phosphorus content (ppm) | 80 | <20 | 20 | 30 | 40 | 25 |

TABLE IV

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| Weight (g) | | 176.0 | 216.0 | 217.0 | 217.0 | 826.0 |
| Specific weight ($G/cm^3$) | 0.892 | 0.889 | 0.890 | 0.891 | 0.893 | 0.891 |
| Union colour | >8 | 1.5 | 2 | 3.5 | 4 | 3 |
| Acid number | 0.25 | 0.03 | 0.04 | 0.05 | 0.07 | 0.05 |
| Conradson residue | 0.28 | 0.07 | 0.08 | 0.08 | 0.09 | 0.08 |
| Ash content (% b.w.) | 0.14 | <0.002 | <0.005 | <0.005 | <0.005 | <0.005 |
| Lead content | | | | | | |

TABLE IV-continued

| | STARTING OIL | 1st SAMPLE | 2nd SAMPLE | 3rd SAMPLE | 4th SAMPLE | MIXTURE OF THE 4 SAMPLES |
|---|---|---|---|---|---|---|
| (ppm) | 650 | 4 | 9 | 9 | 12 | 9 |
| Zinc content (ppm) | 90 | 0.1 | .2 | 0.3 | 0.5 | 0.3 |
| Calcium and barium content (ppm) | 70 | 0.3 | 0.8 | 1.5 | 2.4 | 1.2 |
| Iron content (ppm) | 2 | <0.1 | <0.1 | <0.1 | <0.1 | <0.1 |
| Phosphorus content (ppm) | 520 | 30 | 70 | 80 | 90 | 70 |

What we claim is:

1. A process for regenerating a used lubricating oil, comprising contacting the oil with particles of a solid adsorption resin comprising at least 0.1 cc per gram of pores of a diameter in the range from 6 to 300 angstroms, said resin being a porous polycondensate or cross-linked copolymer comprising (a) hydroxy groups linked directly or through a $-CH_2-$ or $$-\overset{|}{CH}-$$

group to a benzene ring, or (b) pyridyl groups, said contacting being conducted at a temperature wherein the resin is stable.

2. A process according to claim 1, wherein the resin comprises 0.1 to 0.8 cc/g of pores of a diameter in the range from 6 to 300 A and has a water content lower than 1% b.w.

3. A process according to claim 1, wherein the resin is a polycondensate of phenol and formaldehyde.

4. A process according to claim 1, wherein the resin is used as particles in fixed bed.

5. A process according to claim 4, wherein the time of contact is from 15 minutes to 1 hour.

6. A process according to claim 1, wherein the lubricating oil is treated as a solution in a non-solar diluent at a temperature lower than 50° C.

7. A process according to claim 1, wherein the contact with a solid adsorption resin takes place after a treatment of the oil with a macroporous polymer.

8. A process according to claim 1, wherein the contact is followed with reactivation of the resin by contact with an organic solvent.

9. A process according to claim 8, wherein the organic solvent is an alcohol, a ketone or a chlorinated hydrocarbon.

10. A process according to claim 1, wherein the lubricating oil subjected to the regeneration treatment has been previously treated by ultrafiltration.

11. A process according to claim 1, wherein the lubricating oil subjected to the regeneration treatment has been previously treated by extraction with liquid propane and/or butane.

12. A process according to claim 1, wherein the lubricating oil subjected to the regeneration treatment is a distillate of used lubricating oil.

13. A process according to claim 1, wherein the lubricating oil subjected to the finishing treatment has at least one of the following characteristics:

a. Union colour higher than 8, b. Acid number higher than 0.3, c. Conradson carbon residue higher than 0.15% and/or d. Ash content higher than 0.005%.

14. A process according to claim 1 wherein said contacting is conducted at a temperature below about 80° C.

15. A process according to claim 1 wherein said contacting is conducted at a temperature below about 50° C.

16. A process according to claim 14 wherein the resin contains less than 3% by weight of water.

* * * * *